US010550660B2

(12) United States Patent
Carbaugh et al.

(10) Patent No.: US 10,550,660 B2
(45) Date of Patent: Feb. 4, 2020

(54) BLIND SHEAR RAM

(71) Applicant: Hydril USA Distribution LLC, Houston, TX (US)

(72) Inventors: William L. Carbaugh, Humble, TX (US); Martha Flores, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 15/347,444

(22) Filed: Nov. 9, 2016

(65) Prior Publication Data

US 2017/0130550 A1 May 11, 2017

Related U.S. Application Data

(60) Provisional application No. 62/252,913, filed on Nov. 9, 2015.

(51) Int. Cl.
*E21B 33/06* (2006.01)
*E21B 33/064* (2006.01)

(52) U.S. Cl.
CPC ..... *E21B 33/063* (2013.01); *E21B 33/064* (2013.01)

(58) Field of Classification Search
CPC ..... E21B 33/063; E21B 33/064; E21B 33/06; E21B 33/061; E21B 33/062
USPC ..... 251/1.3, 1.1
See application file for complete search history.

(56) References Cited

U.S. PATENT DOCUMENTS 2,608,212 A * 8/1952 Miller ..... F16K 3/243 137/595
3,379,255 A * 4/1968 Burns, Jr. ..... E21B 29/08 166/55
3,736,982 A * 6/1973 Vujasinovic ..... E21B 29/08 166/55
4,081,027 A * 3/1978 Nguyen ..... E21B 29/08 116/55
4,240,503 A * 12/1980 Holt, Jr. ..... E21B 29/08 166/55
4,341,264 A * 7/1982 Cox ..... B23D 21/00 166/55

(Continued)

FOREIGN PATENT DOCUMENTS

CA 1069044 A 12/1979
CN 201826806 U 5/2011

OTHER PUBLICATIONS

Canal, "BOP Shear Rams for Hydrogen Sulfide Service", SPE Drilling Engineering, vol. No. 04, Issue No. 04, pp. 347-350, Dec. 1989.

(Continued)

*Primary Examiner* — Mary E McManmon
*Assistant Examiner* — Jonathan J Waddy
(74) *Attorney, Agent, or Firm* — Hogan Lovells US LLP

(57) ABSTRACT

A system includes a blowout preventer (BOP) including a shear ram assembly. The shear ram assembly includes a first shear ram block having a first forward end, a first blade having a first forward face and extending from the first shear ram block, a face bolt passage extending into the forward end of the shear ram block, a face bolt positioned within the face bolt passage configured to couple the first blade to the first shear ram block, and a first seal containment encapsulated by the first shear ram block.

20 Claims, 5 Drawing Sheets

(56) References Cited

U.S. PATENT DOCUMENTS

| | | | | |
|---|---|---|---|---|
| 5,405,467 | A * | 4/1995 | Young | E21B 33/063 156/91 |
| 5,515,916 | A | 5/1996 | Haley | |
| 5,713,581 | A | 2/1998 | Carlson et al. | |
| 7,207,382 | B2 * | 4/2007 | Schaeper | E21B 33/063 166/55 |
| 7,354,026 | B2 | 4/2008 | Urrutia | |
| 8,464,785 | B2 | 6/2013 | Carbaugh et al. | |
| 8,844,613 | B2 | 9/2014 | Shah et al. | |
| 2004/0262551 | A1 | 12/2004 | Lam | |
| 2006/0021749 | A1 | 2/2006 | Schaeper | |
| 2006/0144586 | A1 | 7/2006 | Urrutia | |
| 2008/0105340 | A1 * | 5/2008 | Huff | C21D 6/004 148/607 |
| 2012/0318493 | A1 * | 12/2012 | Carbaugh | E21B 33/063 166/55 |
| 2013/0153204 | A1 | 6/2013 | Carbaugh et al. | |
| 2013/0168075 | A1 * | 7/2013 | Shah | E21B 33/063 166/55 |
| 2016/0097250 | A1 | 4/2016 | Bleck et al. | |
| 2018/0283127 | A1 * | 10/2018 | Dev | E21B 33/063 |
| 2018/0283128 | A1 * | 10/2018 | Trivedi | E21B 33/063 |
| 2018/0283560 | A1 * | 10/2018 | Trivedi | F16K 3/0227 |
| 2019/0017343 | A1 * | 1/2019 | Lambert | E21B 33/0375 |
| 2019/0017344 | A1 * | 1/2019 | Lambert | E21B 33/063 |

OTHER PUBLICATIONS

PCT Search Report and Written Opinion issued in connection with Corresponding PCT Application No. PCT/US2016/061147 dated Feb. 21, 2017.

PCT IPRP issued in connection with Corresponding PCT Application No. PCT/US2016/061147 on May 15, 2018.

* cited by examiner

BLIND SHEAR RAM

CROSS-REFERENCE TO RELATED APPLICATIONS

This application claims priority to U.S. provisional patent application No. 62/252,913, filed on Nov. 9, 2015, the entire contents of which are incorporated herein by reference.

TECHNICAL FIELD

Embodiments of the subject matter disclosed herein generally relate to oil and gas wells, and in particular to an improved blind shear ram for a blowout preventer (BOP) to be utilized in oil and gas wells.

BACKGROUND

Blowout preventers (BOPs) are typically used in subsea drilling operations to protect an oil well from pressure surges in the well. Generally, BOPs include a series of rams aligned with a central bore. A drill pipe extends through the central bore and into the well below the BOP. Each set of rams is typically positioned with one ram on either side of the central bore. Some rams are designed to seal against the drill string when closed, but not to cut the drill string. Other rams include blades, and are designed to shear the drill string (and anything else in the central bore) when the rams are closed to completely seal the top of the well. These are referred to as shear rams.

A typical BOP includes a bore that runs through the BOP and connects to a wellbore. Pipe and tools are introduced to the wellbore through the bore in the BOP. Generally, blind shear rams are included in a BOP stack, and are used to shear pipe or tools inside a bore where containment of the pressure within the bore is necessary, such as in a situation where an unexpected pressure surge in the well poses a danger to personnel on a rig or other well site.

Blind shear rams typically include shear ram blocks that are mounted inside a housing, or bonnet, on the BOP. The shear ram blocks have blades that are attached to the front ends thereof, toward the bore. When the shear rams are activated, pistons push the shear ram blocks within the housing, causing the shear ram blocks and blades to close across the bore, simultaneously shearing any pipe, tools, or other objects in the bore and sealing the well. As the shear rams close, the shear ram blocks and blades are exposed to the wellbore pressure, which may be very high, such as more than 15,000 pounds per square inch (psi).

Some existing shear ram designs utilize bolts or other fasteners to attach the ram blades to the shear ram blocks. Usually such bolts are passed through the front face of the blade into the block. However, drilling holes through the face of the blade for the fastener may degrade the blade, and may introduce stress paths. In addition, the positioning of the fasteners on the blade requires staggering of the height of the bolts on the blade, leading to uneven distribution of stresses in the bolts under pressure. As a result, it is common for bolts to fracture at pressures higher than about 15,000 psi.

In today's oil and gas industry, however, drilling operations are moving into ever deeper water, which causes ever higher pressures in the wellbore. It is not uncommon, for example, for a BOP to sit on top of a well whose pressure is greater than 15,000 psi, and even up to about 20,000 psi or more, thereby exceeding the operational constraints of known BOP blind shear rams. It may be useful to provide an improved blind shear ram for a BOP suitable in withstanding high pressure and corrosive deep-water environments.

SUMMARY OF THE INVENTION

In accordance with one or more embodiments, a system includes a blowout preventer (BOP) including a shear ram assembly. The shear ram assembly includes a first shear ram block having a first forward end, a first blade having a first forward face and extending from the first shear ram block, a face bolt passage extending into the forward end of the shear ram block, a face bolt positioned within the face bolt passage configured to couple the blade to first the shear ram block, and a first seal containment encapsulated by the first shear ram block.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

Figure 1:
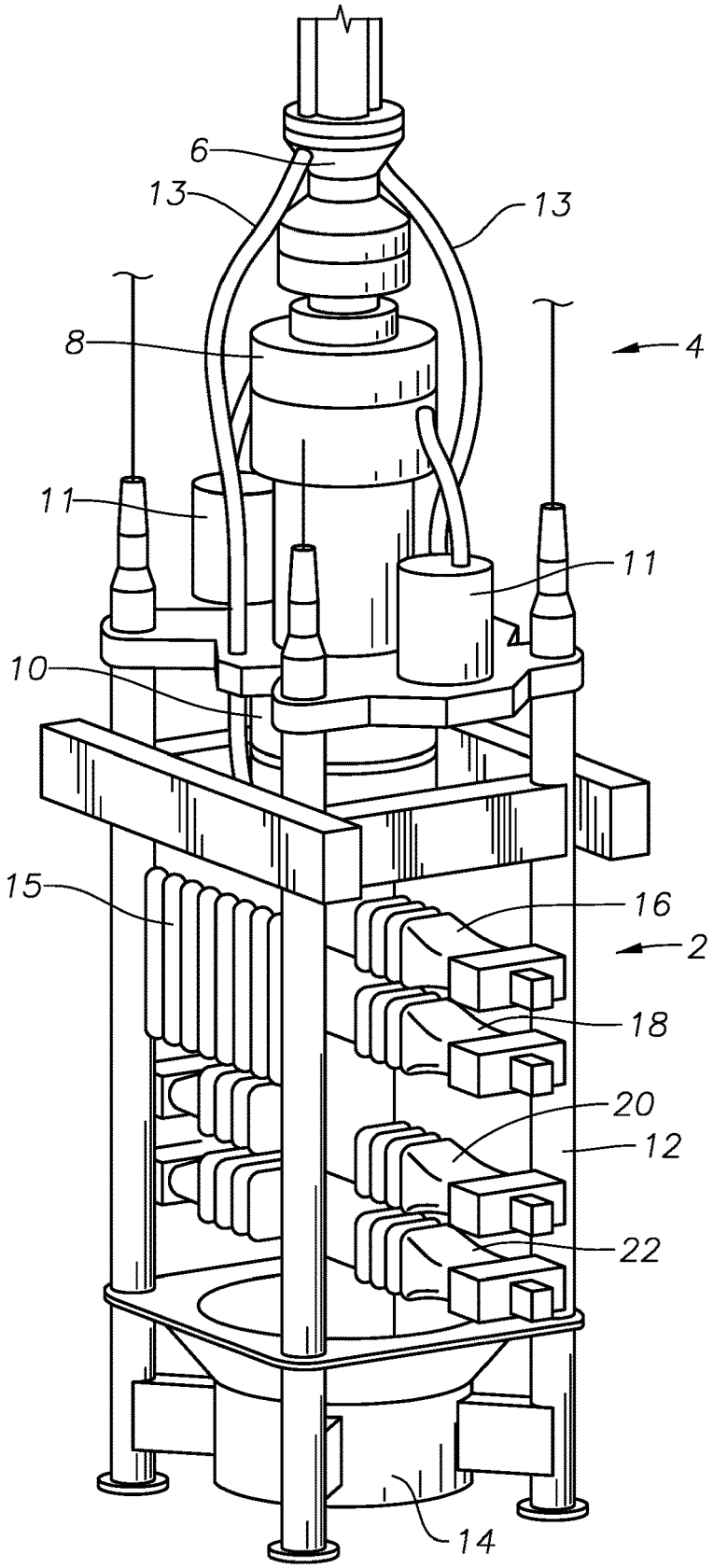
FIG. 1 is a perspective view of a BOP stack assembly attached to a wellhead, in accordance with the present embodiments.

The foregoing aspects, features, and advantages of the present embodiments will be further appreciated when considered with reference to the following description of preferred embodiments and accompanying drawings, wherein the reference numerals represent like elements. In describing the preferred embodiments of the technology illustrated in the appended drawings, specific terminology will be used for the sake of clarity. However, the technology is not intended to be limited to the specific terms used, and it is to be understood that each specific term includes equivalents that operate in a similar manner to accomplish a similar purpose.

In FIG. 1, there is shown a typical subsea BOP assembly, including a lower stack assembly 2, and an upper stack assembly 4, or lower marine riser package (LMRP). The upper stack assembly 4 may include, for example, a riser adapter 6, annular blowout preventers 8, 10, control pods 11, and choke and kill lines 13. The lower stack assembly 2 may include a frame 12 with a wellhead connector 14 at the lower end for connecting to a subsea wellhead assembly (not shown), as well as hydraulic accumulators 15. Typically, a bore runs through the BOP assembly, including through the upper and lower stack assemblies 2, 4, which bore may contain a pipe. A shear ram housing 16 is normally located above pipe ram housings 18, 20, 22 on the lower stack assembly. The shear ram housing 16 contains shear upper and lower ram shear blocks 24, 26 attached to upper and lower blades 28, 30 (shown in FIG. 2). Each pipe ram housing 18, 20, and 22 includes pipe ram blocks (not shown) with semi-circular recesses on the mating faces for closing around different size ranges of pipe. When open the shear and pipe ram blocks are positioned on either side of the bore. When closed, the shear ram blades 28, 30 seal off the bore. If pipe is present in the bore, the shear ram blades 28, 30 will shear the pipe.

Figure 2:
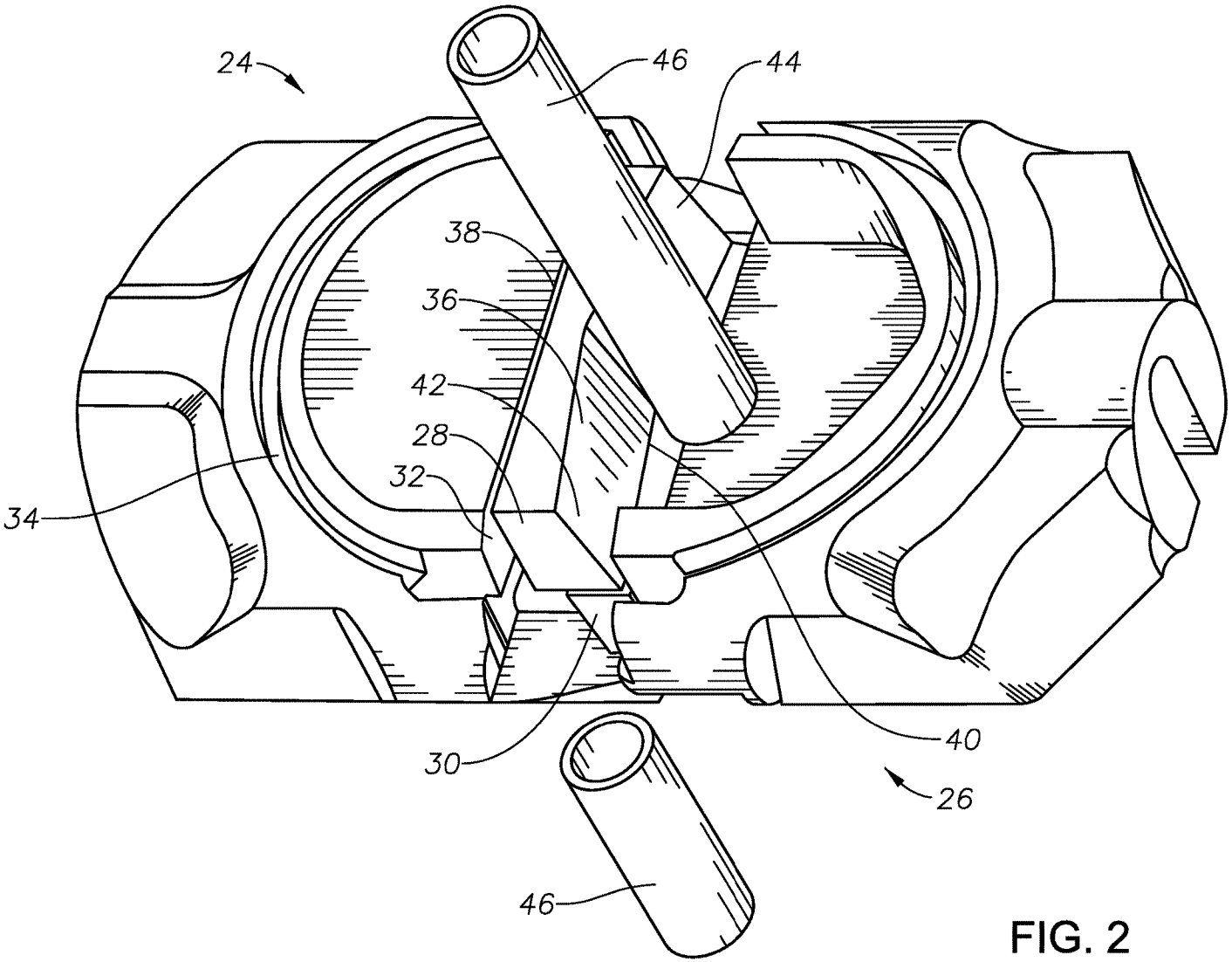
FIG. 2 is a perspective view of upper and lower blind shear rams in a closed position, including a sheared pipe, in accordance with the present embodiments.

Referring now to FIG. 2, there are shown upper and lower shear ram blocks 24, 26 removed from the shear ram housing 16 and in a closed position. The upper shear ram block 24 has a lateral surface that defines a face or forward end 32 and has a rearward face 34. The upper blade 28 mounts to the forward end 32 of the upper ram block 24. The upper blade 28 has a forward face 36 with an upper edge 38 and a lower forward edge 40. For purposes of this disclosure, the term forward, with reference to the ram blocks and associated components, shall mean from forward end 32 of upper shear ram block 24 toward the face 36 of the blade 28. In the example shown in FIG. 2, the lower forward edge 40 of the upper blade 28 extends farther forward from the forward end 32 of the upper shear ram block 24 than does upper edge 38. Face 36 of the upper blade 28 may also be generally concave or converging, resulting in the center of face 36 being recessed relative to the more forward portions of the face 36 at outer ends 42, 44. Of course, different shapes for the upper blade 28 may be employed. As may be seen, when the shear ram blocks 24, 26 are closed, the blades 28, 30 overlap, thereby shearing pipe 46 positioned between the ram blocks 24, 26 in the bore of the BOP.

Figure 3A:
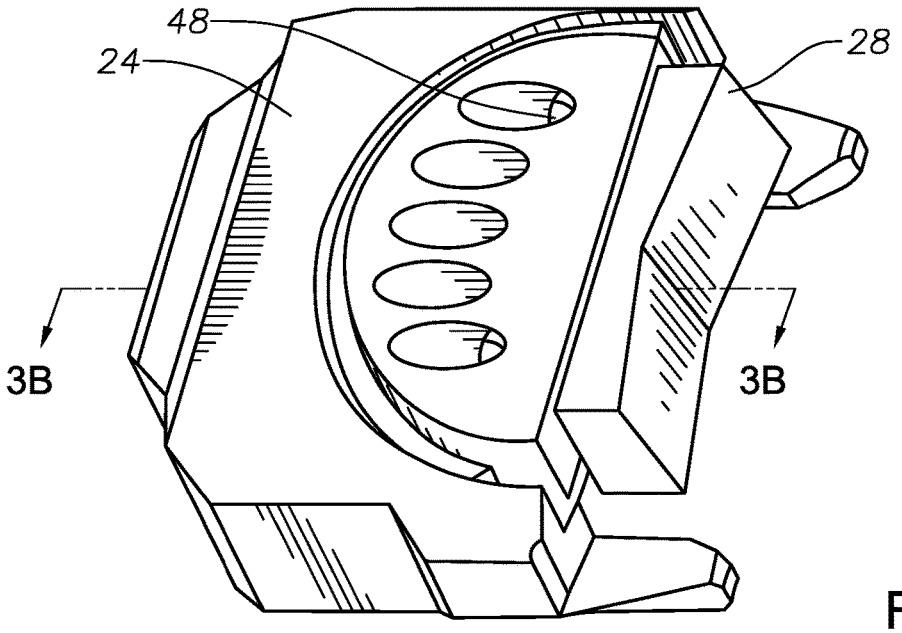
FIG. 3A is a perspective view of a shear ram block and blade, in accordance with the present embodiments.
Figure 3B:
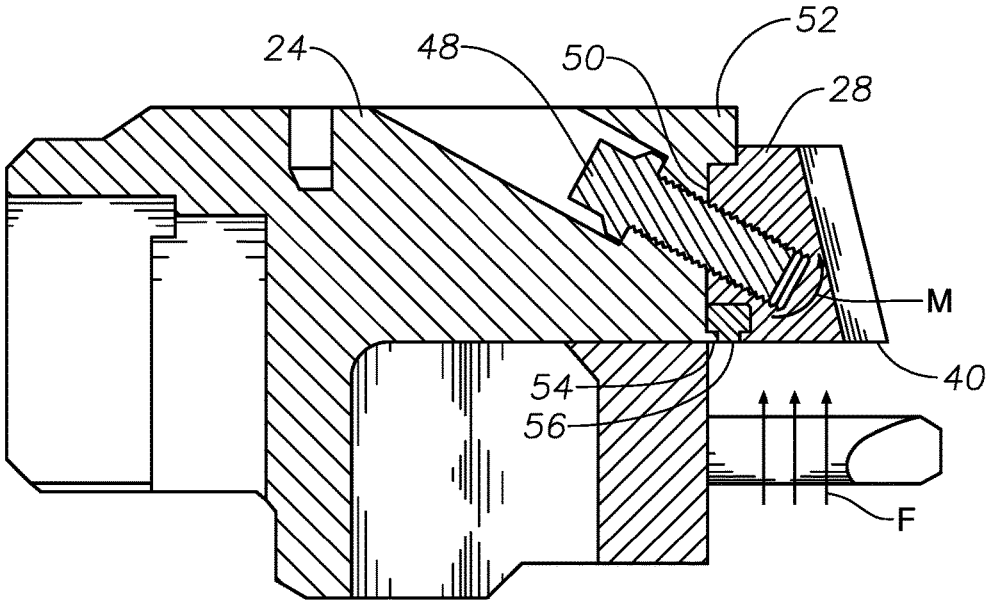
FIG. 3B is a cross-sectional side view of the shear ram block and blade of FIG. 3A taken along line 3B-3B, in accordance with the present embodiments.

Referring to FIGS. 3A and 3B, there is shown a perspective view (FIG. 3A) and a cross-sectional side view (FIG. 3B) of the upper shear ram block 24 and blade 28 in accordance with the present embodiments. To better understand the advantages provided by the present techniques, it is useful to understand the forces acting on the upper shear ram block 24 and the blade 28 during the closing of the shear rams. As the upper shear ram block 24 moves forward to close, the fluid below the upper blade 28 exerts an upward force F on the bottom of the upper blade 28, which may be very high, in some instances exceeding 15,000 psi or 20,000 psi. This upward force F, and in particular that portion of the upward force F acting at or near the forward edge 40 of the blade 28, causes the blade to rotate away from the upper shear ram block 24, and creates a moment M about one or more fasteners 48 (e.g., attachment bolts or cap screws) at the interfaces between the upper blade 28 and the upper shear ram block 24. The features of the present embodiments increase the ability of the upper shear ram block 24 and blade 28 to withstand high pressures by, for example, improving such things as the orientation of the fasteners 48, and the profile of the interface between the upper shear ram block 24 and blade 28.

For example, in the embodiment of FIGS. 3A and 3B, the upper blade 28 is attached to the upper shear ram block 24 using a number of fasteners 48 that are inserted through the upper surface of the upper shear ram block 24 at an angle and into the upper blade 28 through the back surface 50 of the upper blade 28. Such fastening of the blade 28 to the upper shear ram block 24 through the back surface 50 of the blade 28 is advantageous because it reduces or eliminates the use of an increased number of fasteners to pass through the face 36 of the blade 28, and thereby strengthening the blade 28 and reducing possible stress paths through the blade 28. In FIGS. 3A and 3B, the number of fasteners 48 used to attach the upper blade 28 to the upper shear ram block 24 may include 5 or more fasteners 48, but more or fewer bolts may be used without departing from the spirit and scope of the present embodiments. The fasteners 48 may be made from a high strength material such as, for example, high-strength alloy or various other materials that may not be brittle or prone to cracking or significant degradation. For example, an advantage to angling the fasteners 48 through the upper shear ram block 24 and into the back of the blade 28 is that the fasteners 48 may engage the back of the blade 28 in the middle or upper portions of the blade 28, in which the blade 28 has little contact with pipe being sheared. This reduces the shear forces acting on the fasteners 48 compared to attachment at the lower portion of the blade 28.

Also depicted in FIG. 3B is an upper lip 52 of the upper shear ram 24 that extends forward over a portion of the upper blade 28. This upper lip 52 helps to reduce rotation of the upper blade 28, which rotation may be induced by pressure underneath the blade, as discussed above. The placement of the upper lip 52 above the blade 28 helps to block rotation of the blade 28, thereby reducing the magnitude of the moment M at the fastener 48. This is advantageous because it reduces stresses on the fasteners 48 and the upper blade 28, thereby lowering the likelihood that the fasteners 48 or blade 28 will fracture or bend.

Also depicted in FIGS. 3A and 3B is a lower lip 54 extending from the upper shear ram 24 below the upper blade 28, and a seal 56 positioned between the upper blade 28 and the lower lip 54. As the fasteners 48 are tightened, during attachment of the upper blade 28 to the upper shear ram 24, the upper blade 28 is pulled in toward the lower lip 54, thereby energizing the seal 56 and creating a tight hold on the seal 56.

In certain embodiments, the blade 28 may be utilized to encompass the seal 56. The blade 28 is then maintained in place utilizing, for example, the fasteners 28 (e.g., or cap screws or bolts). However, as may be appreciated, due to high loads during pressure testing (e.g., greater than 15,000 psi or greater than 20,000 psi), the fasteners 28 (e.g., attachment bolts or cap screws) may include the use of a high torque to retain the blade 28 attached to the upper shear ram block 24. As will be further appreciated with respect to FIGS. 4-7, by extending the front portion of the upper shear ram 24 to include the seal 56 as opposed to the blade 28 including the seal 56, the high load demand may be removed from the blade 28 and the fasteners 48, and, by extension, the upper shear ram block 24 and the BOP shear ram assembly 2, 4.

For example, in certain embodiments, as will be further appreciated, the upper shear ram block 24 may completely encapsulate the seal 56. This may allow the upper shear blade block 24 to withstand higher hydrogen sulfide (H2S) concentrations, as well as higher pressures (e.g., greater than 15,000 psi or greater than 20,000 psi). The present techniques may also reduce the high preload currently required on the shear bolts of the blade 28, and may eliminate, for example, a number of the fasteners 48 (e.g., attachment bolts or cap screws). Additionally, the present embodiments may reduce the high stress areas within the blade 28 by reducing, for example, bolt torque requirements. Furthermore, the present embodiments may maintain the seal 56 even when, for example, the blade 28 is damaged during operational shearing.

Figure 4:
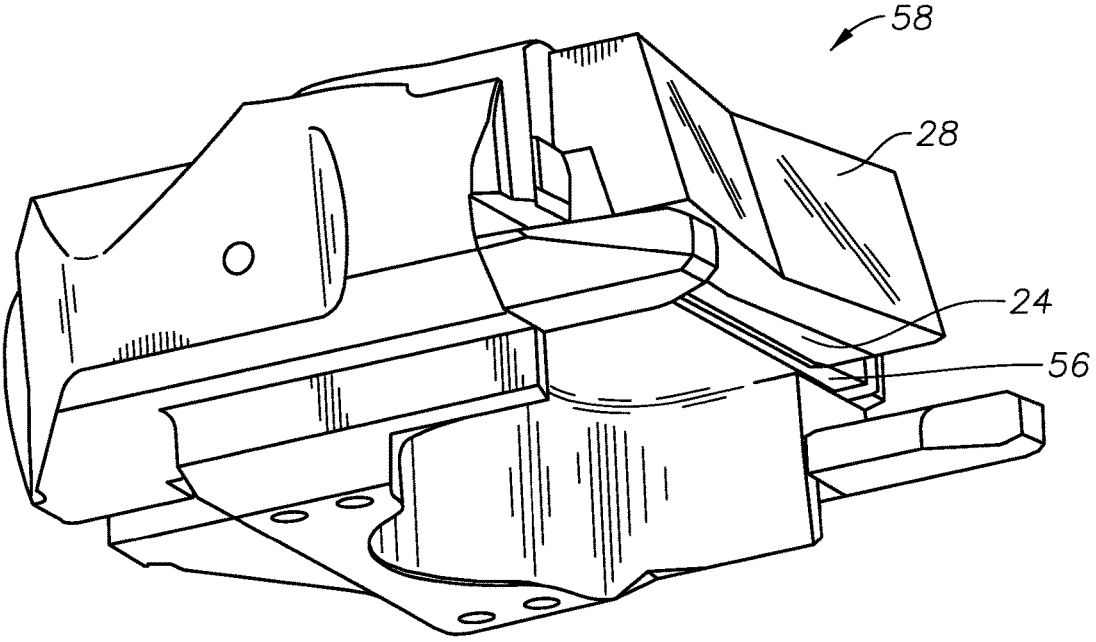
FIG. 4 is a perspective view of a shear ram block and blade, in accordance with the present embodiments.

With the foregoing in mind, FIG. 4 depicts an isometric view of a blind shear ram 58 in accordance with the present techniques. For example, as illustrated, the seal 56 (e.g., lateral T-seal) is encapsulated by the upper shear ram block 24, for example, as opposed to being included as part of the blade 28. In this way, the number of fasteners 48 (e.g., attachment bolts or cap screws) may be reduced. Indeed, by providing the present techniques in which the seal 56 (e.g., lateral T-seal) is encapsulated by the upper shear ram block 24, and thus removing any dependency on the blade 28 to encompass the seal 56, the upper shear ram block 24 and the blade 28, and, by extension, the complete BOP shear ram assembly 2, 4, may be more suitable to be utilized within National Association of Corrosive Engineers (NACE) environments or other corrosive and deep-water environments (e.g., pressures greater than 15,000 psi or greater than 20,000 psi). Specifically, environments referred to herein as "NACE environments" may refer to any environment in which equipment or other assets may be subject to corrosion or any other degradation due to the surrounding environmental conditions (e.g., deep-water environments, underground environments, and so forth). Additionally, by including the seal 56 (e.g., lateral T-seal) as part of the upper shear ram block 24 (e.g., as opposed to being included as part of the blade 28), the number of bolts may be reduced, and thus any high-bolt preload load utilized for retention of the blade 28 may also be reduced.

Figure 5:
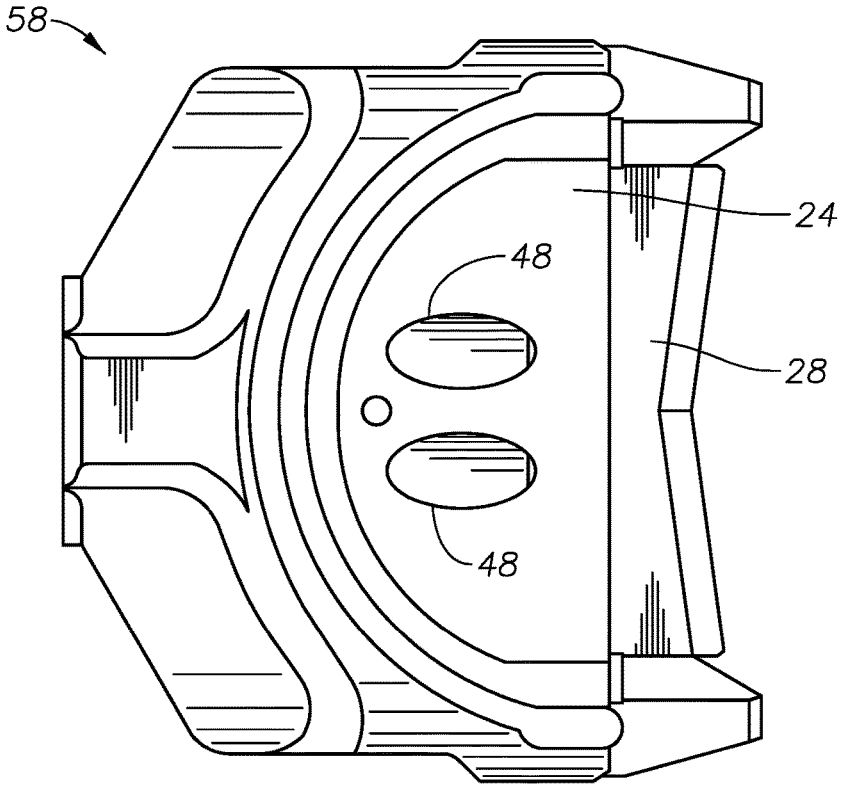
FIG. 5 is a perspective view of a shear ram block and blade, in accordance with the present embodiments.

For example, FIG. 5 depicts a top view of the blind shear ram 58 according to the present techniques. In certain embodiments, in accordance with the present techniques of including the seal 56 (e.g., lateral T-seal) as part of the upper shear ram block 24 (e.g., as opposed to being included as part of the blade 28), only 2 fasteners 48 (e.g., attachment bolts or cap screws) may be utilized to couple the blade 28 to the shear ram block 24 (e.g., as opposed to up to 5 or more fasteners 48 as illustrated with respect to the embodiment of FIG. 3A).

Figure 6:
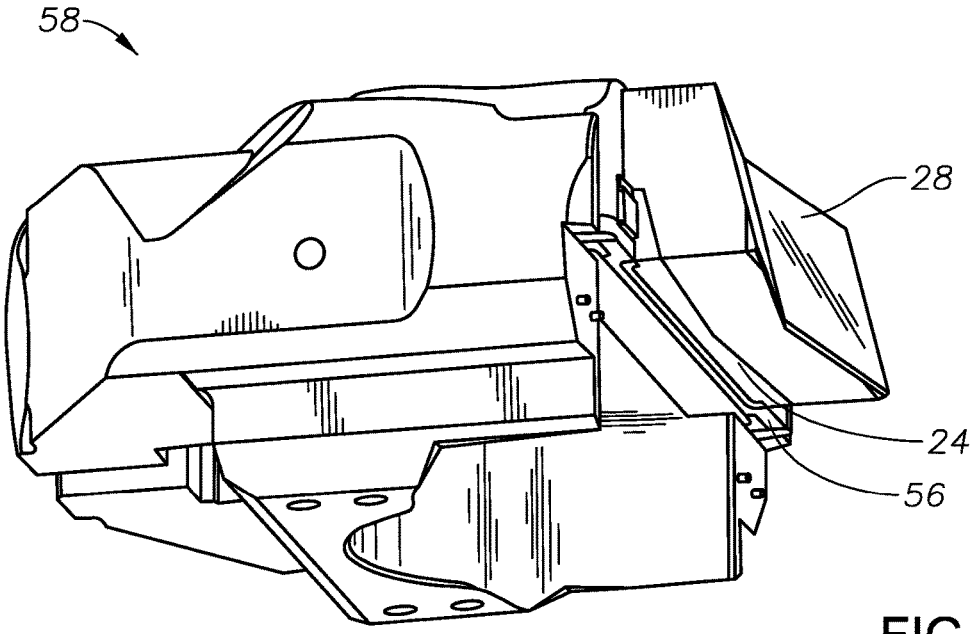
FIG. 6 is a perspective view of a shear ram block and blade, in accordance with the present embodiments.

Similarly, FIG. 6 illustrates another embodiment of the blind shear ram 58 in which one more guide arms of the blind shear ram 58 are not depicted for the purposes of conciseness and clarity. Specifically, FIG. 6 illustrates another view of the blind shear ram 58 in which the seal 56 (e.g., lateral T-seal) is encapsulated by the upper shear ram block 24 (e.g., as opposed to being included as part of the blade 28). In an alternative embodiment to that illustrated in FIG. 6, the upper shear ram block 24 may be machined to allow an attachment plate to facilitate an installation of the t-seal. In such an embodiment, the attachment plate may be located behind the seal 56 (e.g., lateral T-seal).

Figure 7:
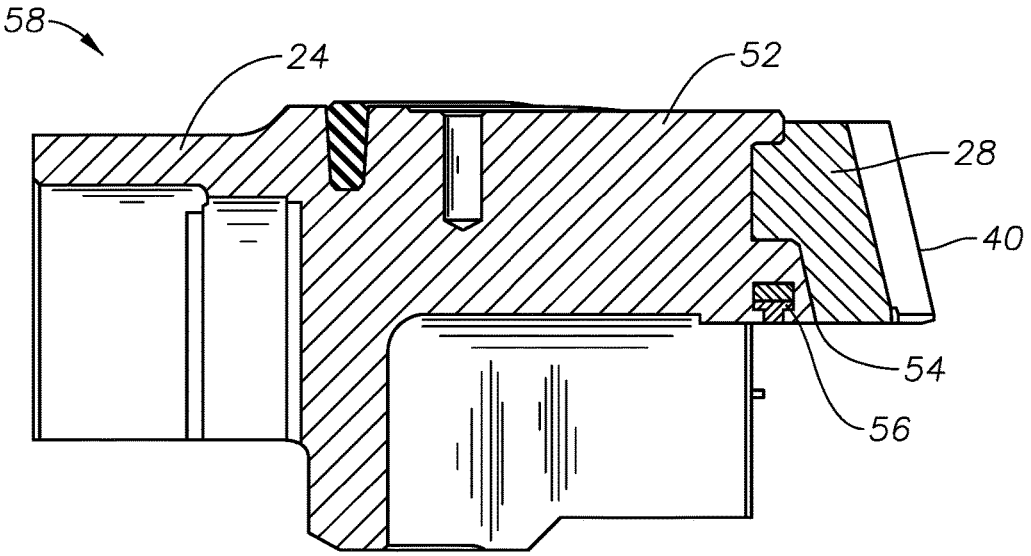
FIG. 7 is a perspective view of a shear ram block and blade, in accordance with the present embodiments.

FIG. 7 depicts a cross-sectional view of the blind shear ram 58 according to an embodiment of the present techniques. As depicted, the seal 56 (e.g., lateral T-seal) is encapsulated by the upper shear ram block 24 (e.g., as opposed to being included as part of the blade 28). For example, as further depicted in FIG. 7, the lower lip 54 extends from the upper shear ram block 24 below the blade 28 and encompasses the seal 56 along with the lower lip 54. As previously noted, in this way, the number of fasteners 48 (e.g., attachment bolts or cap screws) may be reduced. Indeed, by providing the present techniques in which the seal 56 (e.g., lateral T-seal) is encapsulated by the upper shear ram block 24, and thus removing any dependency on the blade 28 to encompass the seal 56, the upper shear ram block 24 and the blade 28, and, by extension, the complete BOP shear ram assembly 2,4, may be more suitable to be utilized within NACE environments or other corrosive and deep-water environments (e.g., H2S environments and environments including pressures greater than 15,000 psi or greater than 20,000 psi). Additionally, by including the seal 56 (e.g., lateral T-seal) as part of the upper shear ram block 24 (e.g., as opposed to being included as part of the blade 28), the number of fasteners 28 (e.g., attachment bolts or cap screws) may be reduced, and thus any high-bolt preload load utilized for retention of the blade 28 may also be reduced or substantially eliminated.

Technical effects of the present embodiments include an improved blind shear ram assembly to be utilized as part of blowout preventer (BOP) that includes a seal as part of the shear ram block of the blind shear ram assembly, as opposed to being included as part of the blade of the blind shear ram assembly. Indeed, by providing the present techniques in which the seal (e.g., lateral T-seal) is encapsulated by the upper shear ram block, and thus removing any dependency on the blade to encompass the seal, the upper and lower shear ram blocks and the blade, and, by extension, the complete BOP shear ram assembly may be more suitable to be utilized within NACE environments or other corrosive and deep-water environments (e.g., H2S environments and environments including pressures greater than 15,000 psi or greater than 20,000 psi). Additionally, by including the seal (e.g., lateral T-seal) as part of the upper shear ram block (e.g., as opposed to being included as part of the blade), the number of fasteners (e.g., attachment cap screws or bolts) may be reduced, and thus any high-bolt preload load utilized for retention of the blade may also be reduced.

The disclosed exemplary embodiments provide an improved blind shear ram. It should be understood, however, that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element may be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The invention claimed is:

1. A blowout preventer (BOP) system, comprising:

a blind shear ram assembly comprising a first shear ram block including a forward face;

a first blade including a first forward face and extending from the first shear ram block; and a first seal encapsulated by the first shear am block, located at a bottom portion of the first shear ram block, and located away from the first blade to allow abutment of the first seal with a second shear ram block of the BOP.

2. The BOP system of claim 1, wherein the first blade is coupled to the first shear ram block by one or more fasteners on a backside of the blade.

3. The BOP system of claim 1, comprising:

the second blind shear ram block including a rearward end; and a second blade including a second forward face and extending from the second shear ram block.

4. The BOP system of claim 3, comprising a second seal, wherein the second seal is encapsulated by the second shear ram block.

5. The BOP system of claim 1, wherein the first seal encapsulated by the first shear ram block increases a resistance of the shear ram assembly to hydrogen sulfide (H2S).

6. A system, comprising:

a blowout preventer (BOP) including a shear ram assembly, wherein the shear ram assembly comprises:

a first shear ram block having a first forward end;

a first blade having a first forward face and extending from the first shear ram block;

a face bolt passage extending into the forward end of the first shear ram block;

a face bolt positioned within the face bolt passage configured to couple the first blade to the first shear ram block; and a first seal encapsulated by the first shear ram block, located at a bottom portion of the first shear ram block, and located away from the first blade to allow abutment of the first seal with a second shear ram block of the BOP.

7. The system of claim 6, wherein the first seal encapsulated by the first shear ram block allows a lower lip of the first shear ram block to extend below the blade.

8. The system of claim 7, wherein a resistance of the first blade to damage is increased as a result of the first seal being encapsulated by the first shear ram block.

9. The system of claim 6, wherein the first seal being encapsulated by the first shear ram block increases a resistance of the shear ram assembly to hydrogen sulfide (H2S).

10. The system of claim 6, wherein the first seal comprises a lateral T-seal.

11. The system of claim 6, wherein the first blade is coupled to the first shear ram block by one or more fasteners on a backside of the first blade.

12. The system of claim 6, comprising:

the second shear ram block having a rearward face; and a second blade having a second forward face and extending from the second shear ram block.

13. The system of claim 12, comprising a second seal, wherein the second seal is encapsulated by the second shear ram block.

14. The system of claim 6, wherein the shear ram assembly comprises a high-strength alloy steel.

15. The system of claim 6, wherein the first shear ram block comprising the first seal encapsulated by the first shear ram block and the first blade, when abutted with the second shear ram block, enables the shear ram assembly to withstand pressures greater than 15,000 pounds per square inch (psi).

16. The system of claim 6, wherein the first shear ram block comprising the first seal encapsulated by the first shear ram block and the first blade, when abutted by the second shear ram block, enables the shear ram assembly to withstand pressures greater than 20,000 pounds per square inch (psi).

17. A shear ram assembly for use in a blowout preventer (BOP), comprising:

an upper shear ram block having a forward face;

an upper blade having a first face and extending from the upper shear ram block;

a plurality of face bolt passages extending into the forward face of the upper shear ram block;

a face bolt located in each of the plurality of face bolt passages and securing the upper blade to the upper shear ram block;

a first seal encompassed by the upper shear ram block, located at a bottom portion of the upper shear ram block, and located away from the upper blade to allow abutment of the first seal with a lower shear ram block of the BOP, the lower shear ram block having a rearward face;

a lower blade having a second face and extending from the lower shear ram block; and a second seal encompassed by the lower shear ram block.

18. The shear ram assembly of claim 17, wherein the first seal encompassed by the upper shear ram block allows a lower lip of the upper shear ram block to extend below the upper blade.

19. The shear ram assembly of claim 17, wherein the first seal and the second seal being encompassed by the upper shear ram block and the lower shear ram block, respectively, increases a resistance of the upper and the lower shear ram blocks to hydrogen sulfide (H2S).

20. The shear ram assembly of claim 17, wherein the upper shear ram block comprising the first seal encapsulated by the upper shear ram block, when abutted by the lower shear ram block, is enabled to withstand pressures greater than 15,000 pounds per square inch (psi).

* * * * *